US005975810A

United States Patent [19]

Taylor et al.

[11] Patent Number: 5,975,810

[45] Date of Patent: Nov. 2, 1999

[54] GEO-GRID ANCHOR

[76] Inventors: Thomas P. Taylor, 2500 Cranberry La., Euless, Tex. 76039; William K. Hilfiker, 3718 Lakeridge Dr., Grapevine, Tex. 76051

[21] Appl. No.: 09/053,363

[22] Filed: Apr. 1, 1998

[51] Int. Cl.[6] ..... E02D 29/02; E02D 3/02

[52] U.S. Cl. ..... 405/262; 405/284; 405/286

[58] Field of Search ..... 405/262, 284, 405/286, 258, 285, 272, 273

[56] References Cited

U.S. PATENT DOCUMENTS

| | | | |
|---|---|---|---|
| 4,324,508 | 4/1982 | Hilfiker et al. | 405/284 |
| 4,616,959 | 10/1986 | Hilfiker | 405/286 |
| 4,661,023 | 4/1987 | Hilfiker | 405/262 |
| 4,920,712 | 5/1990 | Dean | 52/169.4 |
| 4,929,125 | 5/1990 | Hilfiker | 405/262 |
| 4,993,879 | 2/1991 | Hilfiker | 405/262 |
| 5,257,880 | 11/1993 | Janopaul | 405/284 |
| 5,451,120 | 9/1995 | Martinez-Gonzalez | 405/262 |
| 5,456,554 | 10/1995 | Barrett et al. | 405/284 |
| 5,484,235 | 1/1996 | Hilfiker | 405/284 |
| 5,522,682 | 6/1996 | Egan | 405/262 |
| 5,525,014 | 6/1996 | Brown | 405/262 |
| 5,533,839 | 7/1996 | Shimada | 405/284 |

FOREIGN PATENT DOCUMENTS

| | | | |
|---|---|---|---|
| 402209522 | 8/1990 | Japan | 405/262 |

OTHER PUBLICATIONS

Sweet's Engineering and Retrofit: Mechanical, Civil/Structural 1993 Catalog File, published by McGraw–Hill(1993), Section 02276/(KEY, ROC and AND) (Earth Retainage, Buylines 2802 (Keystone), 6342 (Rockwood), and 7682 (Diamond).

*Primary Examiner*—Dennis L. Taylor

[57] ABSTRACT

A flexible plastic soil reinforcing element is secured to the retaining face for an earthen formation by folding an end portion of the element upon itself and then securing the end portion to the face. An anchor extends rearwardly from the face and a retaining rod is engaged with the end portion of the soil reinforcing element and the anchor to secure the reinforcing element against separation from the anchor. In one embodiment, the end portion of the reinforcing element is folded upon itself multiple times to increase the shear strength of the element to either side of the anchor. In another the end portion of the reinforcing element is folded back over the reinforcing element for embedment in the earthen formation.

31 Claims, 9 Drawing Sheets

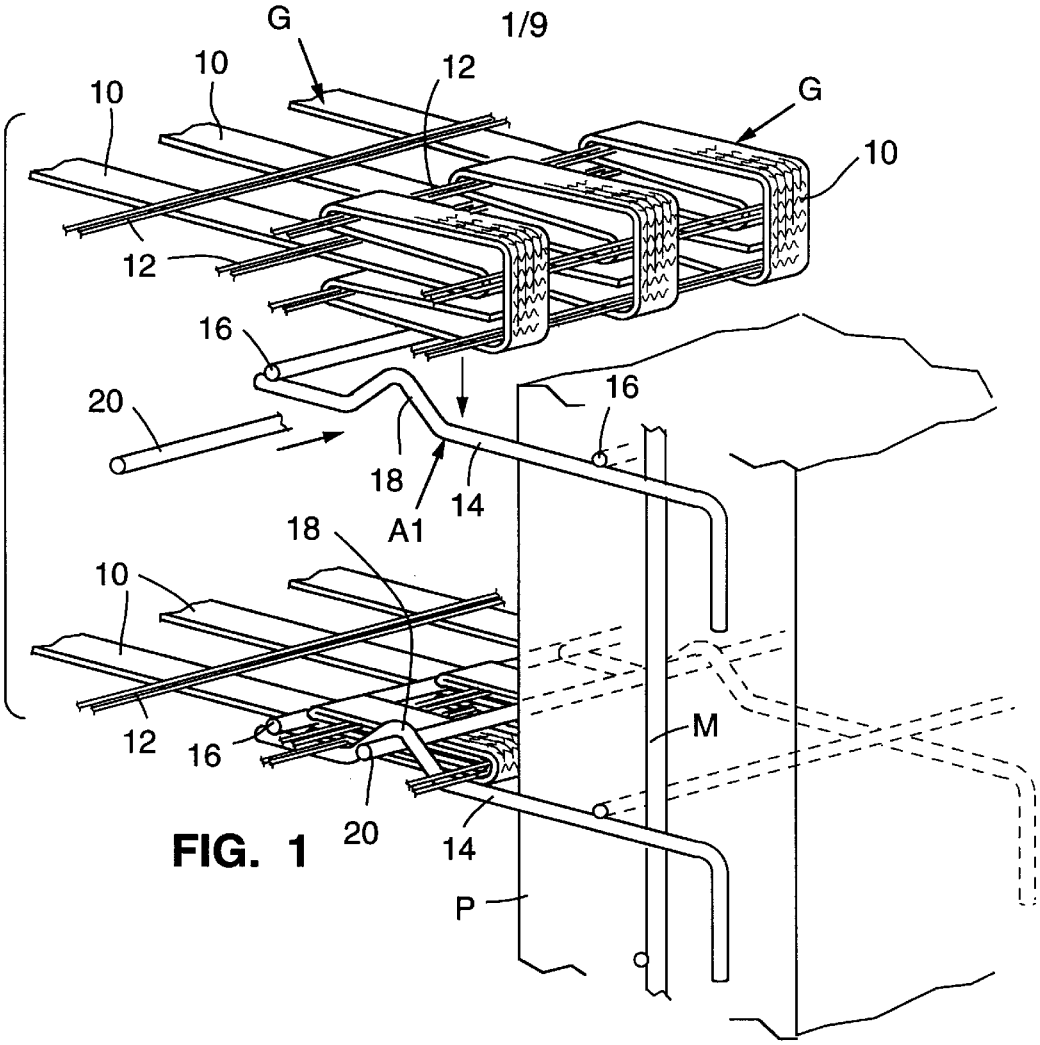
FIG. 1
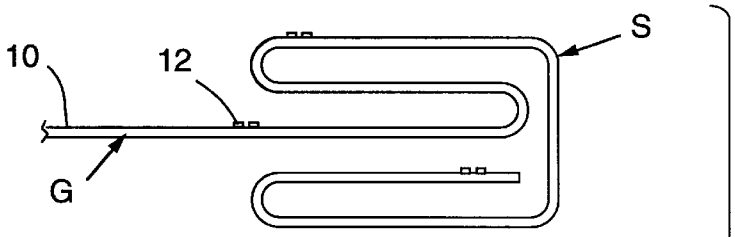
FIG. 2
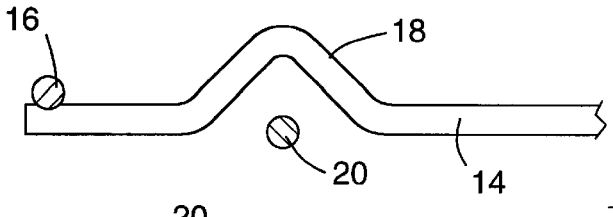
FIG. 3
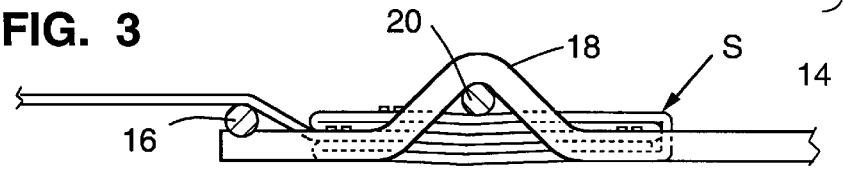

GEO-GRID ANCHOR

FIELD OF THE INVENTION

The present invention relates to a new and improved way of joining polymer or other flexible plastic soil reinforcing geo-grids to the face of a retained earthen formation. In its more particular aspects, the invention is concerned with a connection which is made outside the confines of the facing element and which has improved strength, as compared to connections which are dependent upon the shear strength of the joinder between the tension members and the transverse tying members of a geo-grid.

BACKGROUND OF THE INVENTION

Prior art connections between soil reinforcing polymer geo-grids and the face elements for retained earthen formations have required that the connection be made within the concrete face elements, either by passing pins through openings in the geo-grids, or by sandwiching the geo-grids between the face elements. In the case of the pin connections, the integrity of the connection has been dependent upon the shear strength of the joinder between the longitudinal tension members of the geo-grids and the transverse tying members extending across the tension members. In the case of connections which rely upon sandwiching of the geo-grid between face panel elements, the connection has been dependent upon capturing the grid between the concrete elements and the frictional interengagement of the grid and concrete elements. Such dependence upon friction results in a connection which is never as strong as the structural properties of the geo-grid polymer. The geo-grid also has a thickness which causes the panels to gap when stacked and be uneven and result in uneven stresses at the connection. Typical prior art connections between polymer geo-grids and concrete face panel elements may be seen in U.S. Pat. Nos. 4,616,959 and 5,257,880.

The prior art also teaches various types of connections between welded wire geo-grids and the facing elements for retained earthen formations. These connections have been made both within and without the confines of the face elements. In some instances, the connection is made directly to the longitudinal soil reinforcing elements of the welded wire gridwork. In others, it is made to the transverse tie elements of the gridwork. Although connections of the latter type are dependent upon the shear strength of the joinder between the longitudinal and transverse elements of the gridwork, the problem is not as troublesome as it is with flexible plastic geo-grids because of the increased shear strength of the welded wire joinders, as compared to polymer joinders. U.S. Pat. Nos. 4,324,508, 4,661,023, 4,929,125 and 5,484,235 disclose connections which are typical of those used for joining welded wire gridworks to face panels.

SUMMARY OF THE INVENTION

The present invention is for use in combination with a polymer or other flexible plastic soil reinforcing geo-grid having spaced tension members extending into an earthen formation and transverse members extending across the tension members at spaced intervals. It provides an improved connection for securing the geo-grid to a retaining face for the earthen formation wherein the connection point to the geo-grid is spaced rearwardly from the face. The principal elements of the connection comprise an end portion of the geo-grid folded or rolled back upon itself, an anchor secured to and extending rearwardly from the face, which anchor has a protruding section extending through an opening in the geo-grid, and a retaining rod secured to the anchor to hold the geo-grid in place relative to the anchor. In one embodiment, the end portion of the geo-grid is folded upon itself a plurality of times to provide multiple transverse members to opposite sides of the opening in the geo-grid through which the anchor extends. In another, the end portion of the geo-grid is folded back upon itself to provide continuous overlapping tension members extending into the earthen formation. Other embodiments establish connection by wrapping the geo-grid around the rod and then securing the rod to the face. The connection is adapted for securement to literally any type of face element which may be used for a retained earthen formation, for example: pre-cast concrete panels; cast-in-place concrete elements; concrete blocks; and welded wire.

A principal object of the invention is to provide a connection of increased strength for securing a soil reinforcing polymer or other flexible plastic geo-grid to the face of an earthen formation.

Another object is to provide such a connection which is made outside the confines of the facing element.

A more specific object of the invention is to provide such a connection wherein increased strength is provided by folding an end portion of the geo-grid upon itself multiple times and then extending an anchor secured to the face through the folded portion so that multiple transverse tie members are provided to either side of the anchor.

Still another object of the invention is to provide a connection wherein the longitudinal tension members of the geo-grid are folded back upon themselves to provide a loop which extends around a rod secured to the face and then back into the formation.

Another object related to the latter object is to provide a connection between the tension members of the geo-grid and the face element which is not dependent upon the shear strength or integrity of the tie elements which extend between the tension elements.

A further object of the invention is to provide a connection where the tension elements of the geo-grid wrap around a rod which, in turn, is secured to the face by anchor elements extending from the face.

Another object of the invention is to provide such a connection where the anchor secured to the face is manufactured from a structural steel grid providing multiple protrusions which may be secured to a geo-grid.

These and other objects will become more apparent when viewed in light of the following description and accompanying drawings.

BRIEF DESCRIPTION OF THE DRAWINGS

FIG. 1 is a perspective view of a face panel and a pair of flexible plastic geo-grids connected by a first embodiment of the invention wherein the end portions of the geo-grids are folded upon themselves multiple times and then positioned horizontally over protruding anchors embedded within the face panel, with the lower part of the figure showing the completed connection, and the upper part of the figure showing the connection in exploded perspective;

FIG. 2 is an exploded elevational view of the first embodiment connection;

FIG. 3 is an elevational view of the completed first embodiment connection;

DETAILED DESCRIPTION OF THE PREFERRED EMBODIMENTS

Figure 5:
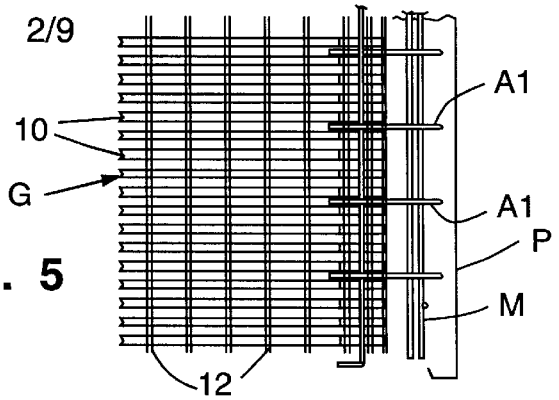
FIG. 5 is a plan view of the earthen formation shown in FIG. 4, with parts thereof broken away, illustrating the connection of the first embodiment.

The various embodiments of the invention will now be described in detail. In these embodiments, the flexible plastic geo-grid G is shown as comprising elongated woven tension members 10 extending into an earthen formation and transverse members 12 secured to and extending across the tension members at spaced intervals to tie the tension members together The dimensions and material of the geo-grid may vary. For example, in one commercially available geo-grid, the material is polyester and apertures defined between the intersecting tension and transverse members measure approximately one inch between the tension members and approximately two inches between the transverse members (e.g., the STRATA GRID 600 manufactured by Strata Systems Inc. of Alpharetta, Ga.). The welded wire gridworks used for the face elements in certain embodiments are of conventional construction and may, for example, be of the same general type of material disclosed for the gridworks in U.S. Pat. No. 4,391,557 by William K. Hilfiker, one of the inventors herein. The size and spacing of the wires and other materials will, of course, depend on the application and be apparent to those having skill in this art. The anchor and rod elements may be made from steel that is hot-dipped galvanized, or epoxy coated. They could also be manufactured from high strength plastics. To further protect the connection, the area immediately adjacent to the back side of the face could be filled with non-corrosive fill material that is separated from the corrosive fill by a filter fabric wrap.

FIRST EMBODIMENT (FIGS. 1 to 5)

FIG. 1 shows the connection of this embodiment in use in securing a flexible plastic geo-grid G to a concrete face panel P having a wire reinforcing mat M and anchors A1 embedded therein. The anchors A1 are formed of welded wire mat having rods 14 which extend out of the panel P and are secured together by transversely extending rods 16 extending there across. The rods 14 include a generally inverted V-shaped protrusion 18 extending upwardly therefrom.

The geo-grid G has an end portion adjacent the face panel P folded upon itself a plurality of times to provide a sandwich S comprised of a plurality of juxtaposed layers of the geo-grid. As shown in FIG. 2, the tension members 10 of the geo-grid extending into the earthen formation (see FIG. 4) are sandwiched between layers of the geo-grid folded to either side thereof. The apertures extending between the transverse members 12 of the geo-grid are aligned in the sandwich to provide an opening extending therethrough with multiple transverse members disposed to either side of the opening, as may be seen from FIG. 1. In the assembled connection, the protrusion 18 is extended through the opening, and a rod 20 is extended beneath the apex of the protrusion and over the top of the sandwich (see FIG. 3 and the bottom connection in FIG. 1). As a result of this arrangement, the geo-grid is securely fastened to the anchors A1 and the tension members 10 extend from the connection into the earthen formation (see FIG. 4). The multiple transverse members to either side of the protrusion 18 increase the shear strength of the connection, as compared to what it would be if only a single layer of the geo-grid were secured to the protrusion. The rod 20 maintains the sandwich under compression and thus increases the frictional pullout resistance of the tension members within the sandwich to some degree. All of this adds to the strength of the connection between the anchors and the geo-grid.

Figure 4:
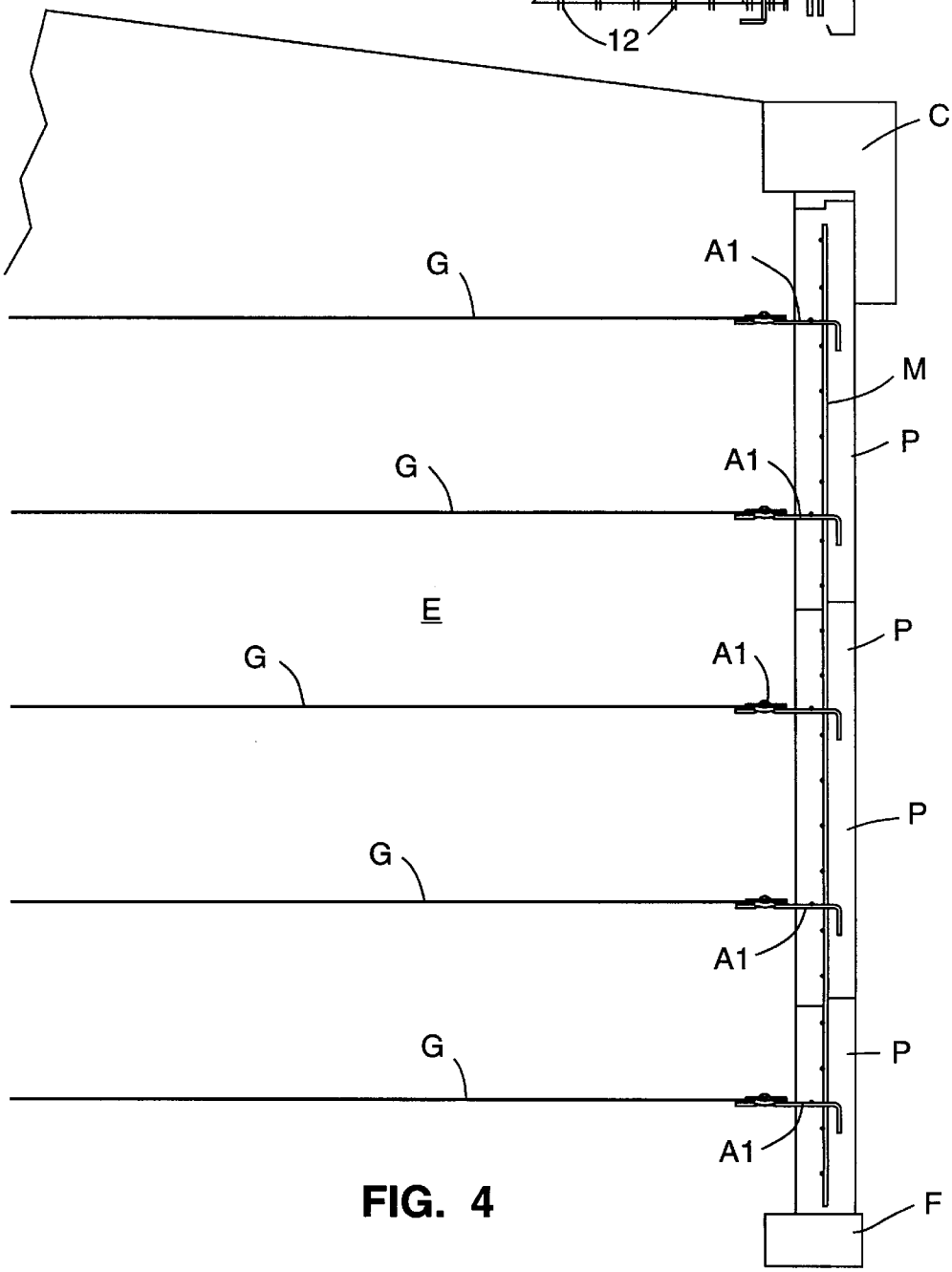
FIG. 4 is an elevational view, in section, illustrating an earthen formation retained with flexible plastic soil reinforcing geo-grids secured to face panels by the connections of the first embodiment.

FIG. 4 graphically illustrates a retaining wall constructed with the first embodiment connection. As there shown, it will be seen that the connections between the geo-grids G and the panels P are disposed rearwardly of the panels and extend generally horizontally. The longitudinal tension members 10 of the geo-grids G extend into the earthen formation, designated E. The face panels P in FIG. 1 are shown supported on a foundation F and capped by a cap C.

Figure 6:
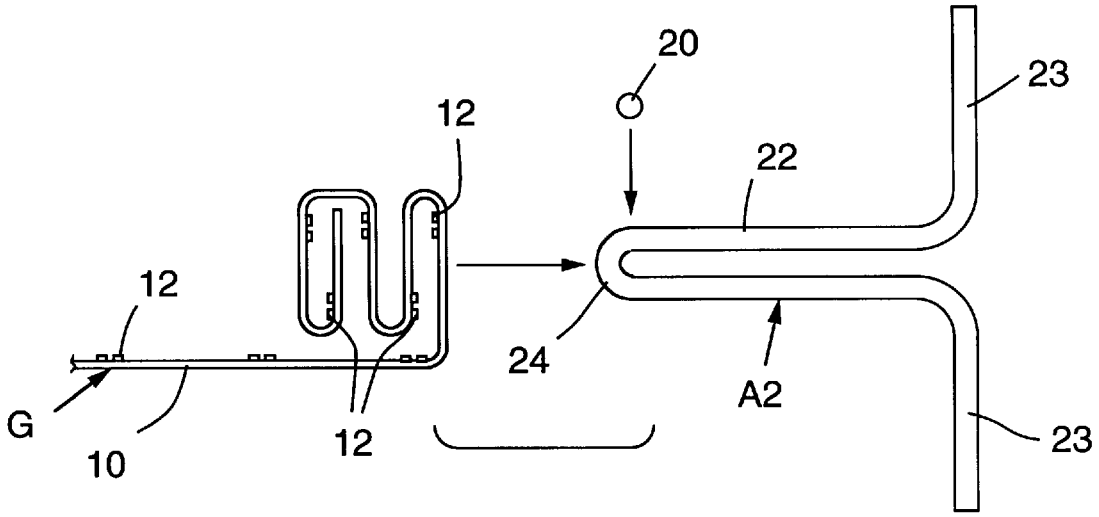
FIG. 6 is an exploded elevational view diagrammatically illustrating the components of a second embodiment of the inventive connection wherein the end portion of the flexible plastic geo-grid is folded upon itself multiple times and then positioned vertically over a horizontally protruding loop anchor.
Figure 7:
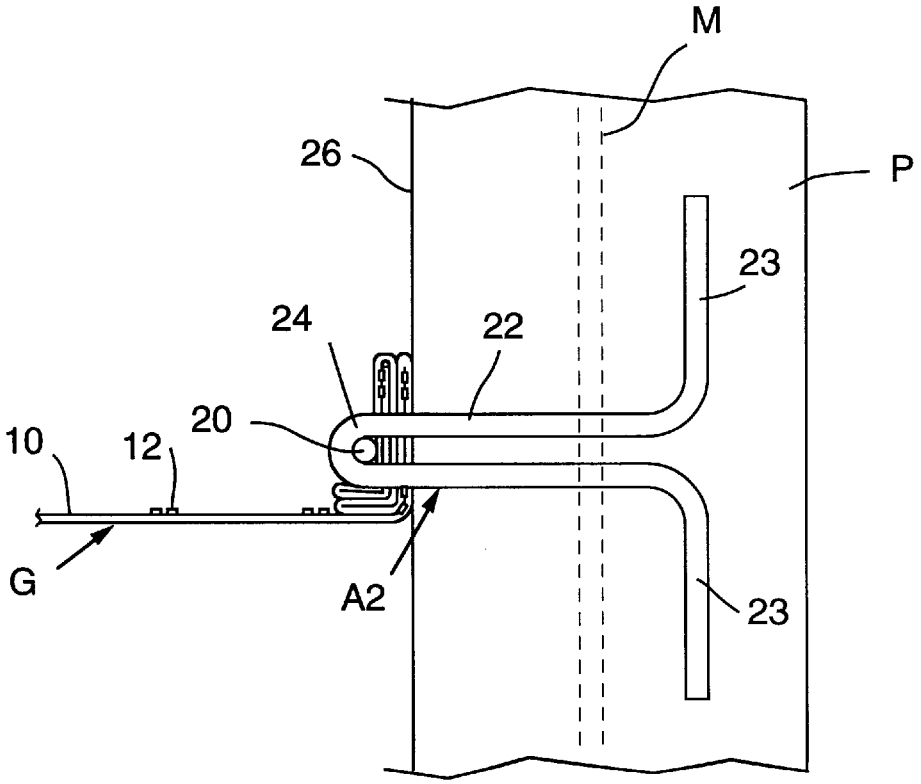
FIG. 7 is a cross-sectional elevational view illustrating the second embodiment connection assembled to secure a flexible plastic geo-grid to a concrete face panel.

SECOND EMBODIMENT (FIGS. 6 and 7)

This embodiment is similar to the first embodiment in that it employs a flexible plastic geo-grid G with an end portion folded upon itself multiple times to the rear of a face panel P. In this case, however, the end portion is folded back and forth upon itself and then turned to a vertical position, as may be seen from FIG. 6. There it will also be seen that the apertures defined between the cross members in the end portion are aligned to define an opening extending therethrough.

The anchor of the second embodiment is designated A2 and comprises a loop portion 22 with diverse legs 23. In the assembled condition shown in FIG. 7, the anchor is cast-in-place within the panel P with the closed distal end 24 of the loop portion extending horizontally and rearwardly from the panel. The geo-grid is secured to the anchor by passing the opening defined by the aligned apertures in the folded end portion over the distal end 24 of the anchor, as depicted by the horizontal arrow line in FIG. 6. Once so placed, the geo-grid is secured to the anchor by passing a retaining rod 20 horizontally through the closed distal end 24 and over the multilayered turned-up end portion of the geo-grid. Such placement of the rod serves to clamp the multi-layered portion of the geo-grid to the rear surface 26 of the panel P. The resulting connection relies for its strength both on the increased number of transverse members 12 to either side of the loop portion 22 and on the longitudinal strength of the tension members 10. Resistance against pullout of the geo-grid from the anchor is also aided by the frictional contact of the multilayers forming the turned up end portion of the geo-grid. The tension member 10 of the geo-grid extending into the formation is actually sandwiched between the rear surface 26 of the panel P and multilayers of the folded end portion of the geo-grid.

Figure 8:
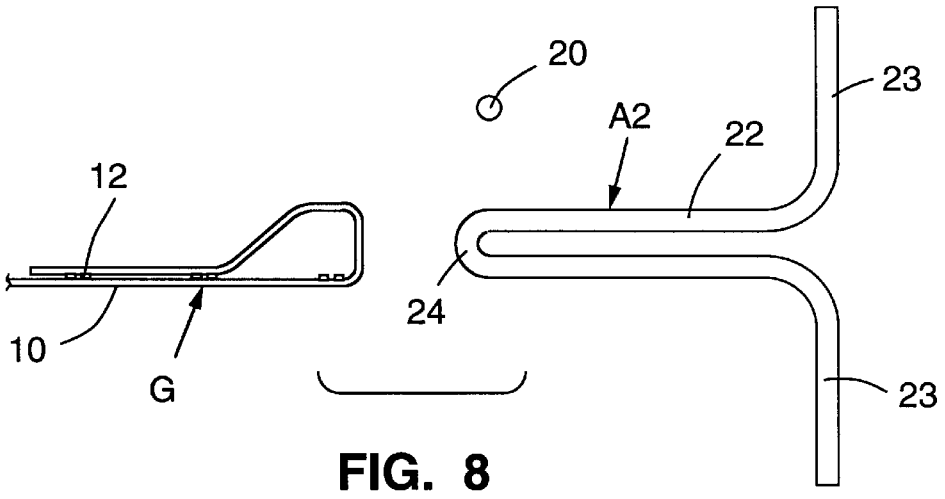
FIG. 8 is an exploded elevational view diagrammatically illustrating the components of a third embodiment of the inventive connection wherein the end portion of the geo-grid is folded back upon itself to provide overlaying tension members for embedment in an earthen formation.
Figure 9:
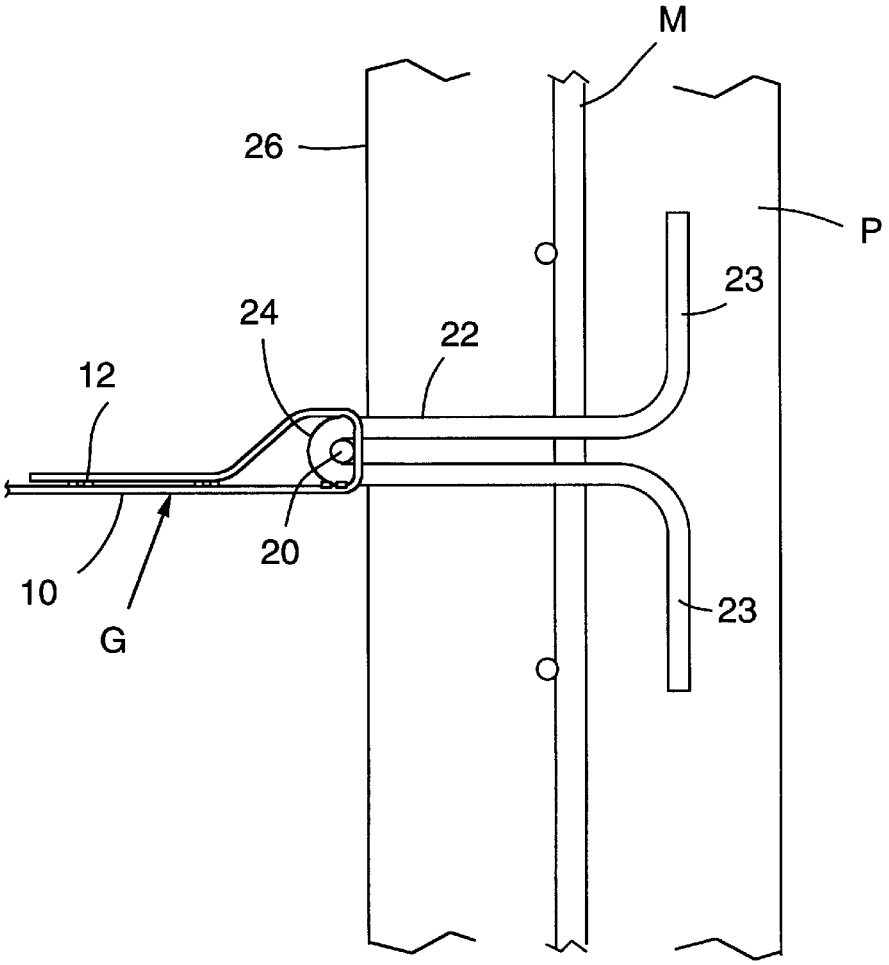
FIG. 9 is a cross-sectional elevational view illustrating the third embodiment connection assembled to secure a flexible plastic geo-grid to a concrete face panel.

THIRD EMBODIMENT (FIGS. 8 and 9)

This embodiment employs an anchor A2 corresponding to that of the second embodiment. In casting the anchor in place within the panel P, however, the anchor is positioned so that the distal end 24 extends outwardly from the rear surface 26 of the panel by lesser degree than that of the second embodiment. (This difference may be seen from a comparison of FIGS. 7 and 9.)

The flexible plastic geo-grid of the third embodiment is connected to the panel P by folding the end portion of the geo-grid back upon itself so that the tension members 10 of the folded over section overlie and extend into the earthen formation. Connection is completed by extending the pin 20 horizontally through the folded over end of the geo-grid and the distal ends 24 of the anchors, as may be seen from FIG. 9.

In assembly of the third embodiment connection, the end portion of the geo-grid G is folded over as shown in FIGS. 8 and 9 and then positioned between the distal ends 24 of adjacent anchors. The pin 20 is then passed horizontally through the ends and over the tension members, as shown in FIG. 9. Connection is completed by backfilling soil over the geo-grid, thus creating passive resistance of the overlapping tension members. The extent to which the tail section of the end portion is overlapped to the body of the geo-grid extending into the formation will depend upon the soil conditions and the connection strength desired.

The third embodiment connection relies on the longitudinal strength of the tension members 10 of the geo-grid and the passive resistance of the backfill that is placed upon the folded over tail section of the end portion of the geo-grid which extends into the earthen formation. This connection does not rely upon the strength of the junction between the tension members 10 and the transverse members 12 and is not dependent upon the integrity of the transverse members.

Figure 10:
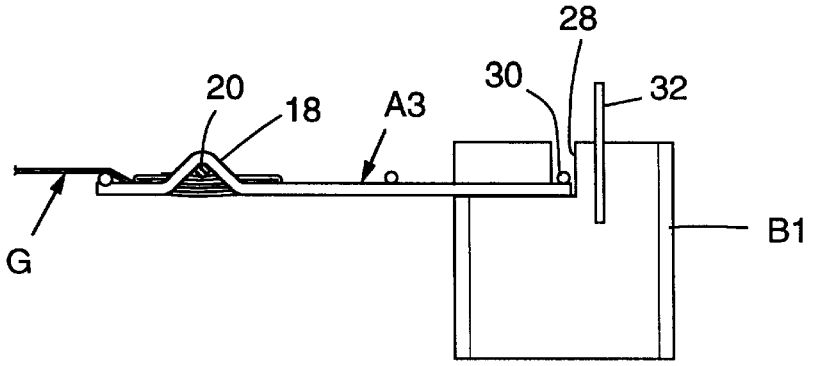
FIG. 10 is an elevational view illustrating the components of a fourth embodiment of the inventive connection wherein the end portion of the flexible plastic geo-grid is folded upon itself multiple times and then positioned horizontally over a protruding anchor secured within and extending from a transverse slot in a concrete block.
Figure 11:
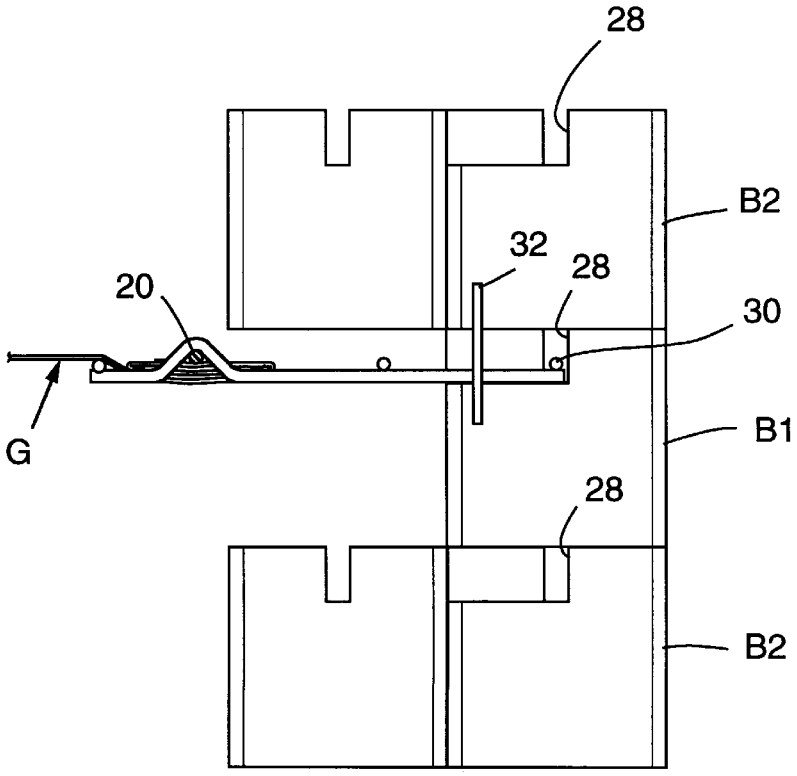
FIG. 11 is a cross-sectional elevational view illustrating the fourth embodiment connection assembled to secure a flexible plastic geo-grid to a face panel comprised of stacked concrete blocks.

FOURTH EMBODIMENT (FIGS. 10 and 11)

The fourth embodiment connection corresponds to that of the first embodiment in that it employs an anchor having an upstanding protrusion which is extended through a horizontally disposed sandwich of flexible plastic geo-grid layers and then held in place by a rod 20 extended through the protrusion and over the sandwich. It differs from the first embodiment connection primarily in that the face panel to which the geo-grid is being secured is comprised of stacked concrete blocks B1 and B2 having transverse slots 28 extending thereacross and that the anchor, designated A3, is formed of welded rods having a cross member 30 received within the slots 28. Engagement of the cross members 30 in the slots 28 secures the anchors to the block panel.

In the assembled wall, the blocks B1 and B2 are stacked as shown in FIG. 11. Pins 32 extend through aligned openings in the blocks B1 and B2 to maintain the blocks in vertical alignment. The cross members 30 serve to assist in maintaining adjacent blocks in horizontal alignment.

Figure 12:
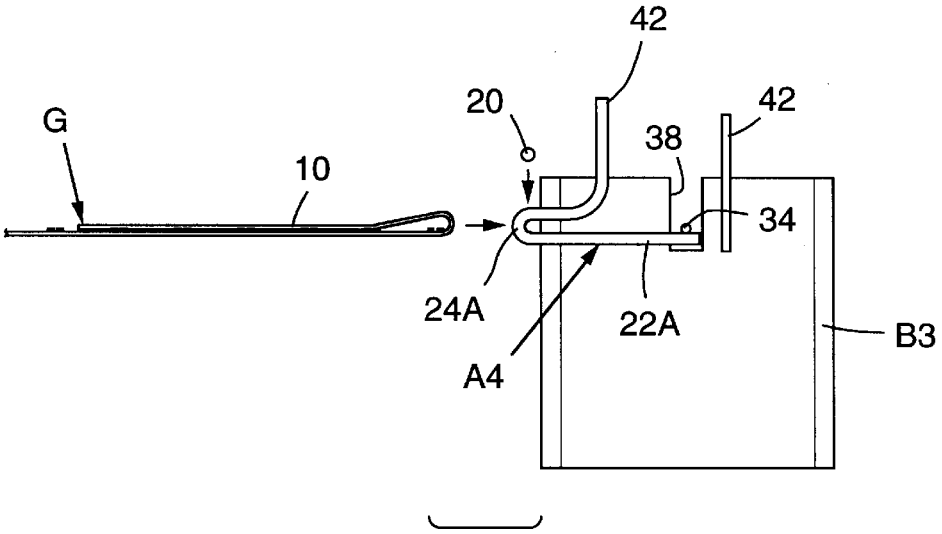
FIG. 12 is an exploded elevational view diagrammatically illustrating the components of a fifth embodiment of the invention connection wherein the end portion of the flexible plastic geo-grid is folded back upon itself to provide overlaying tension members for embedment in an earthen formation and the protruding anchor of the connection is received within a transverse groove extending across a concrete block.
Figure 13:
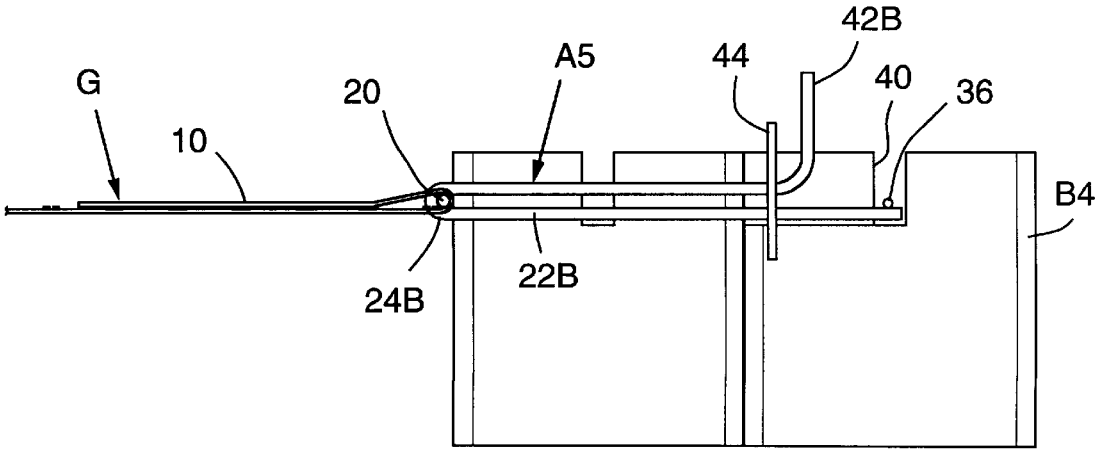
FIG. 13 is a cross-sectional elevational view illustrating the fifth embodiment connection assembled to secure a flexible plastic geo-grid to a groove extending transversely across a multi-cell concrete block.

FIFTH EMBODIMENT (FIGS. 12 and 13)

This embodiment employs a loop anchoring system corresponding generally to that of the third embodiment, except that the face panel is comprised of transversely slotted concrete blocks B3, B4, and the anchors, designated A4, A5, are provided with cross members 34, 36 for receipt within the slots of the blocks. The slots within the blocks B3 are designated 38, and the slots within the blocks B4 are designated 40. Vertically extending alignment pins 42, 44 extend upwardly from the blocks B3, B4 for engagement with blocks stacked thereover.

The anchor A4 is comprised of a loop portion 22A and the distal end portion 24A. An extension 42 extends inwardly and upwardly from the distal end 24 for extension into the void of a block stacked over the block B3.

The anchor A5 corresponds to the anchor A4, except that it is longer to accommodate the increased depth of the block B4. It comprises a loop portion 22B, a distal end 24B and an extension 42B.

The connection between the flexible plastic geo-grid G and the anchors A4, A5 of the fifth embodiment is achieved in the same manner as that of the third embodiment. Namely, the end portion of the geo-grid is folded back upon itself so that the tension members therein overlay and extend into the earthen formation. The folded over end is secured to the anchors A4, A5 by passing a rod 20 horizontally through the distal ends of the anchors and the folded over portion of the geo-grid. The arrow lines in FIG. 12 diagrammatically illustrate placement of the geo-grid relative to the anchor and placement of the pin 20 through the anchor. FIG. 13 shows the assembled connection with the geo-grid and anchor connected together by the pin 20.

Figure 15:
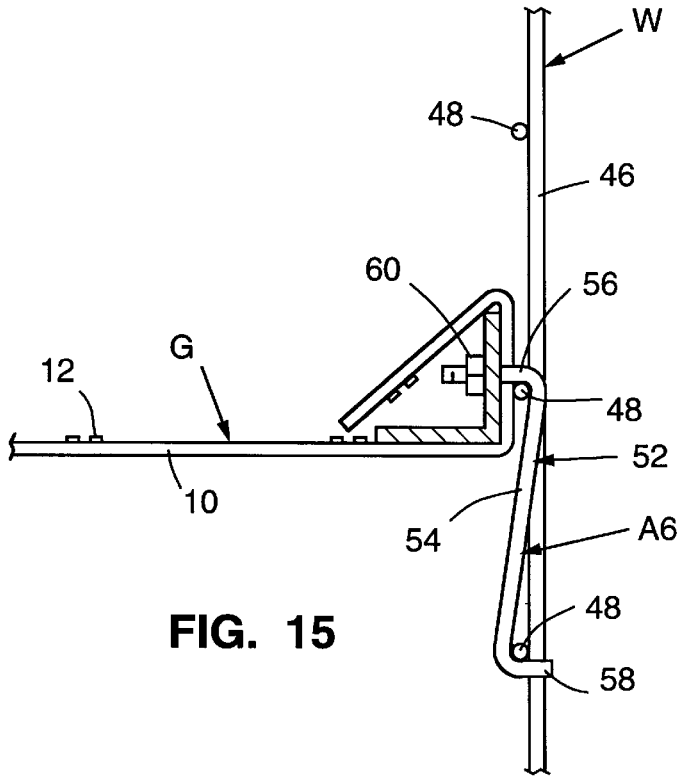
FIG. 15 is a cross-sectional elevational view illustrating the sixth embodiment connection assembled and secured in place on a welded wire gridwork.
Figure 16:
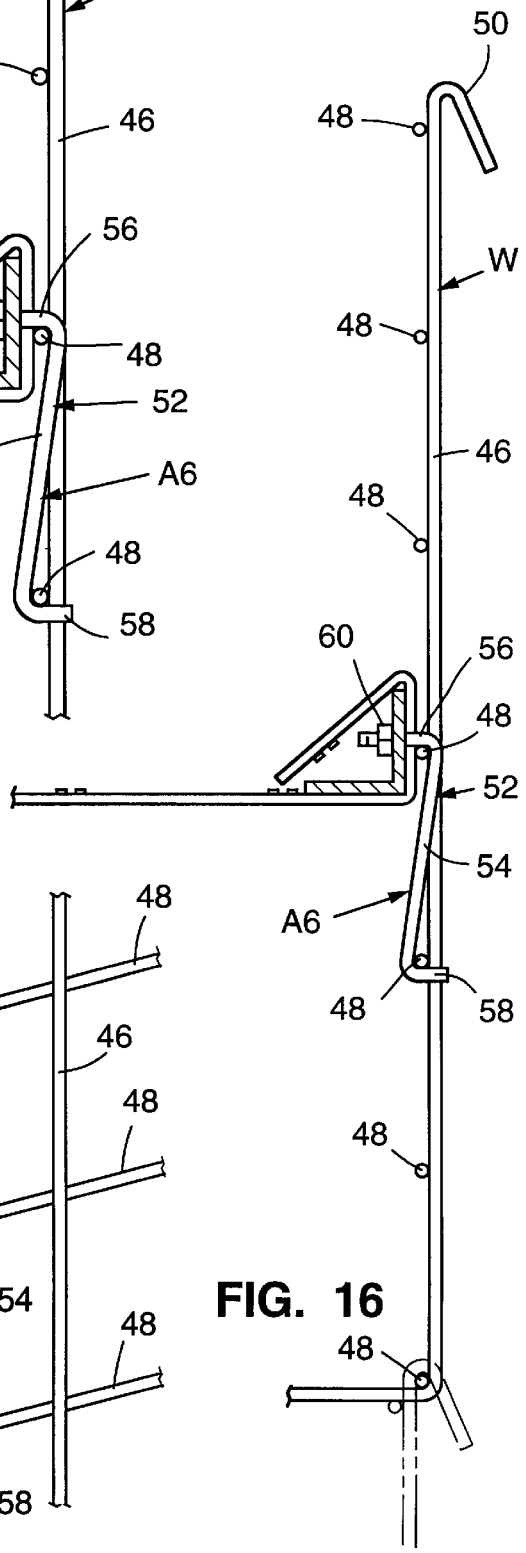
FIG. 16 is a cross-sectional elevational view corresponding to FIG. 15, illustrating the sixth embodiment connection in place on a welded wire gridwork having a hooked end facilitating its use in the assembly of a multi-tiered retaining wall.
Figure 14:
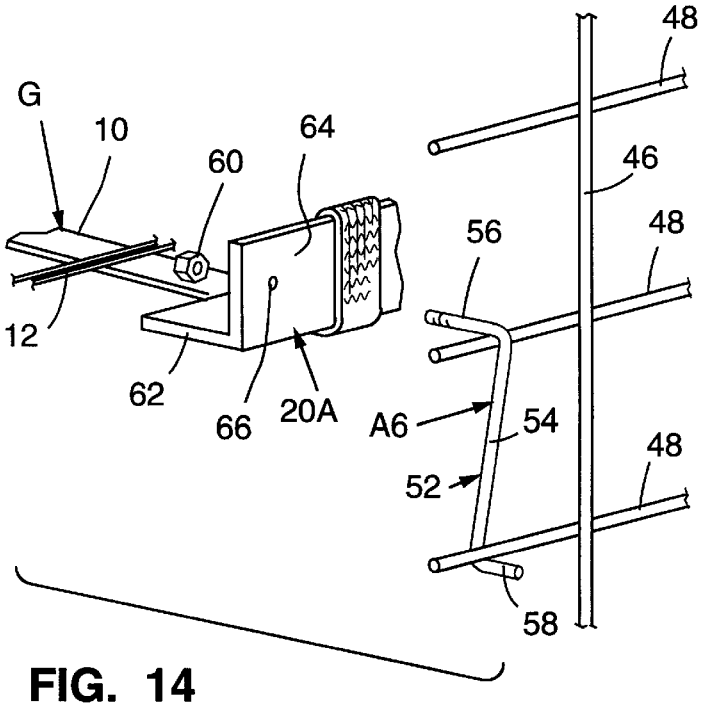
FIG. 14 is an exploded perspective view illustrating the components of a sixth embodiment of the inventive connection designed for securing a flexible plastic geo-grid soil enforcement to a face comprising a welded wire gridwork, wherein the geo-grid is wrapped around an angle-shaped rod attached to a Z-shaped anchor engaged over and under the transverse wires of the welded wire gridwork.

SIXTH EMBODIMENT (FIGS. 14 to 16)

In this embodiment, the face of the retained earthen formation comprises welded wire gridwork section W having longitudinal wires 46 extending vertically and horizontally extending transverse wires 48 secured to the longitudinal wires at spaced intervals. At the upper ends, the longitudinal wires 46 are formed with hooked over portions 50. The lower ends of the sections W are bent inwardly at the lowermost transverse wire 48. In the assembled face, the hooked over portion 50 of each section W is engaged over the lowermost transverse wire 48 of the section W thereabove (see the phantom line illustration at the bottom of FIG. 16).

The anchor A6 of the sixth embodiment comprises a Z-shaped wire 52 having a bight portion 54 proportioned for extension between adjacent transverse wires 48 and end portions 56, 58 disposed for engagement over and under the adjacent transverse wires. The end portion 58 is screw-threaded for engagement by a nut 60.

The retaining rod of the sixth embodiment, designated 20A, comprises a horizontally extending angle-shaped member having intersecting horizontal and vertical legs 62 and 64, respectively. The vertical legs are provided with apertures 66 through which the threaded end portions 56 of the anchor A6 are extended during assembly of the connection.

In making the connection of the sixth embodiment, the tension members 10 of the flexible plastic geo-grid are wrapped around the rod 20A, as may be seen from FIGS. 15 and 16, and the end portions 56 of the anchors A6 are then extended through the apertures 66. Completion of the connection is achieved by threadably engaging the nuts 60 with the end portions 56 to secure the rods to the gridwork sections W and clamp the tension members between the transverse wires 48 and the vertical legs 64 of the rods 28 (see FIGS. 15 and 16). The resulting connection relies upon the longitudinal strength of the tension members 10 and is not dependent upon the transverse members 12 or the integrity of the junction between the tension members and the transverse members.

Figure 18:
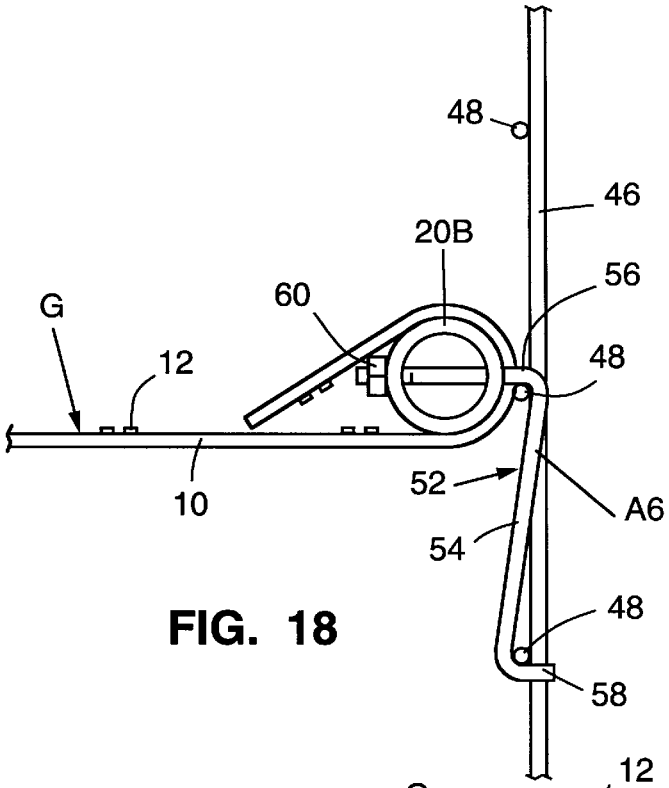
FIG. 18 is a cross-sectional elevational view illustrating the seventh embodiment connection assembled and secured in place on a welded wire gridwork.
Figure 19:
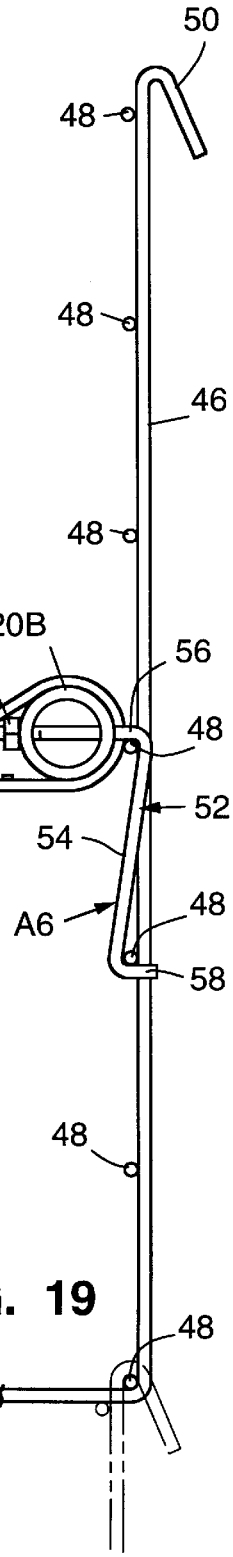
FIG. 19 is a cross-sectional elevational view corresponding to FIG. 18, illustrating the seventh embodiment connection in place on a welded wire gridwork having a hooked end facilitating its use in the assembly of a multi-tiered retaining wall.
Figure 17:
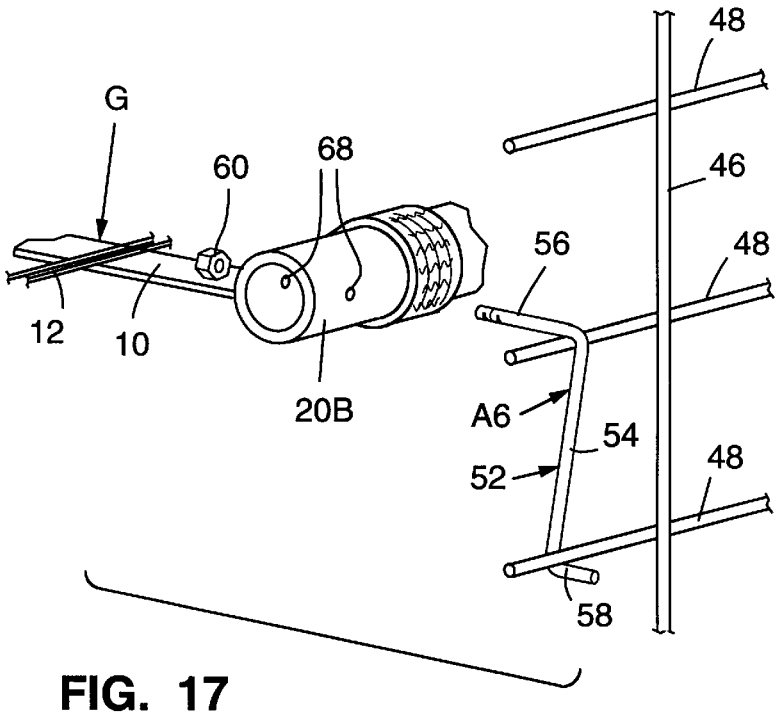
FIG. 17 is an exploded perspective view illustrating the components of a seventh embodiment of the inventive connection designed for securing a flexible plastic geo-grid soil enforcement to a face comprising a welded wire gridwork, wherein the geo-grid is wrapped around a cylindrical rod attached to a Z-shaped anchor engaged over and under the transverse wires of the welded wire gridwork.

SEVENTH EMBODIMENT (FIGS. 17 to 19)

The seventh embodiment corresponds to the sixth embodiment, except that the horizontally extending securing rod, designated 20B, is of a cylindrical cross-section, rather than an angle-shaped cross-section. Accordingly, elements of the seventh embodiment corresponding to those of the sixth embodiment are designated by the same numbers. The cylindrical cross-section of the rod 20B necessitates that pairs of the aligned apertures 68 extend therethrough for receipt of the threaded end portion 56 of the anchor A6.

The seventh embodiment connection is assembled in a manner corresponding to that of the sixth embodiment. In this assembly, the tension members of the flexible plastic geo-grid are wrapped around the rod 20B and then clamped between the transverse members 48 and the rod. Clamping is achieved by extending the end portions 45 through the aligned apertures 68 and then engaging the nuts 60 with the threaded portions of the end portions 56. Like the sixth embodiment, the connection relies upon the longitudinal strength of the tension members 10 and is not dependent upon the integrity of the transverse members 12 or the strength of the joinder between these members and the tension members 10.

Figure 20:
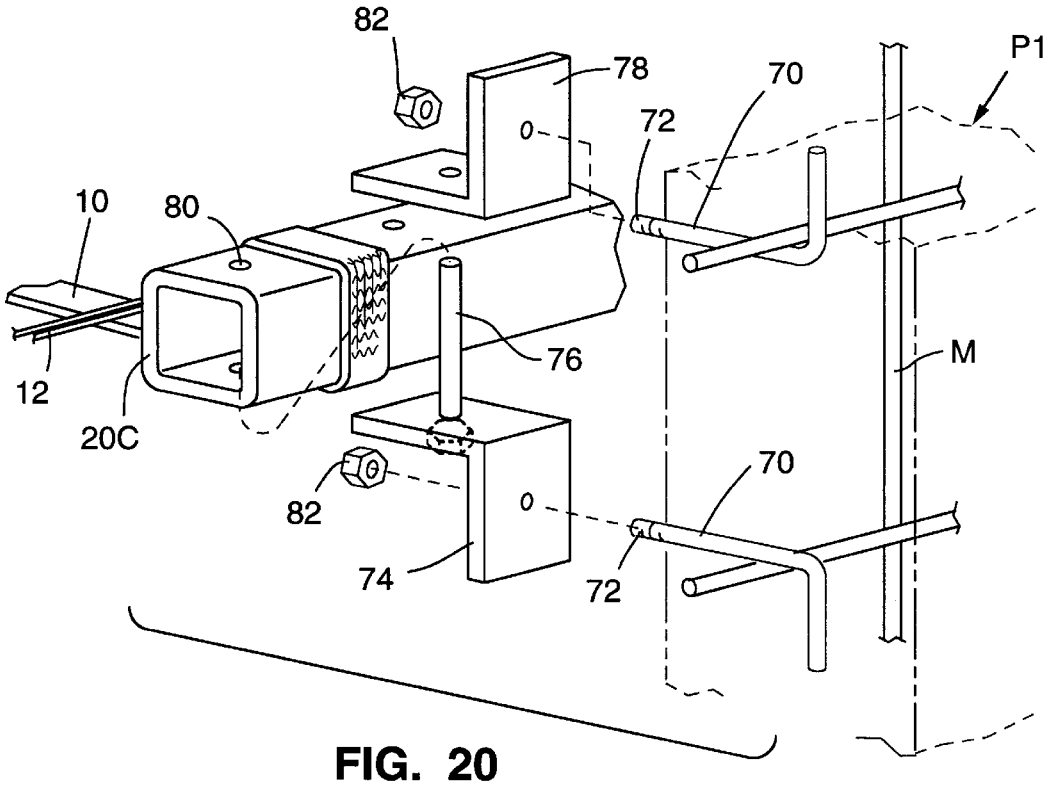
FIG. 20 is an exploded perspective view illustrating the components of an eighth embodiment of the inventive connection designed for securing a flexible plastic geo-grid soil reinforcement to a pre-cast concrete panel, wherein the geo-grid is wrapped around a rectangular rod attached between anchors secured to the panel.
Figure 21:
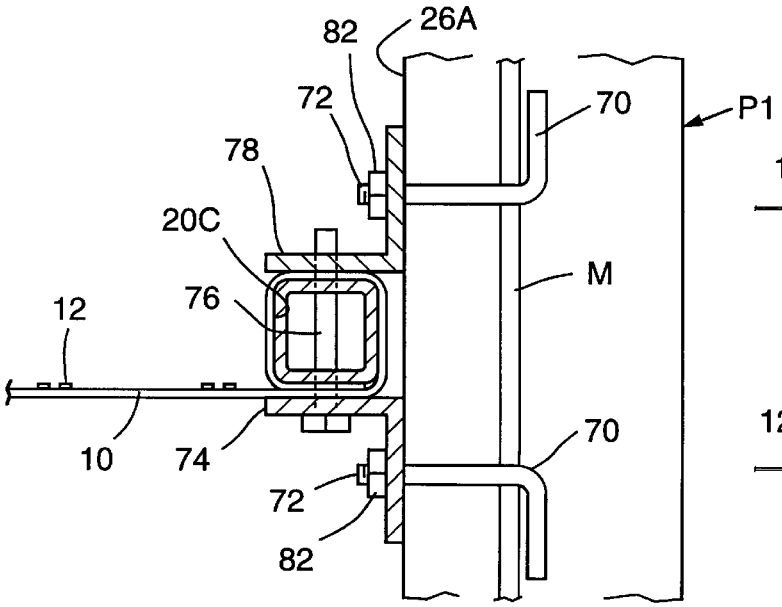
FIG. 21 is a cross-sectional elevational view illustrating the eighth embodiment connection assembled and secured into place on a concrete panel; and, FIG. 22 is a cross-sectional elevational view illustrating a pair of the eighth embodiment connections assembled and secured in place in vertically spaced relationship on a panel.
Figure 22:
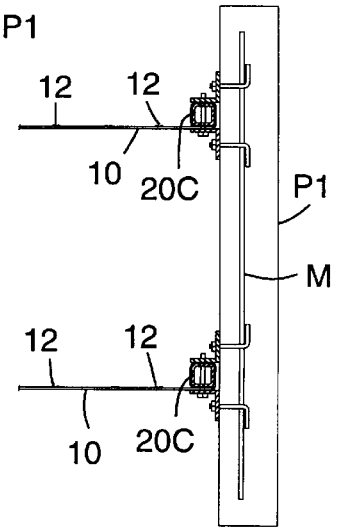

EIGHTH EMBODIMENT (FIGS. 20 to 22)

This embodiment employs a retaining rod 20C of a rectangular cross-section which extends horizontally across a concrete face panel P1 for an earthen formation. The panel has a vertically extensive dimension, as may be seen from FIG. 22, and is internally reinforced by a mat M. Angle-shaped anchor bolts 70 are cast in place within the panel P1 and have screw threaded end portions 72 extending from the rear surface 26A of the panel. As can be seen from FIG. 21, the anchor bolts are arranged in spaced pairs, and each extend through an angle-shaped anchor element. The anchor element secured to the lower anchor bolt of each pair is designated 74 and has a pin 76 fixed thereto and extending upwardly therefrom. The anchor element secured to the upper anchor bolt of each pair is designated 78 and has an aperture therein through which the pin 76 slideably extends when the connection is fully assembled.

In assembling the connection of the eighth embodiment, the angle-shaped anchor elements 74 are first secured in place of the face of the panel with the pins 76 extending upwardly from the element. The tension members 10 of the flexible plastic geo-grid are then wrapped fully around the rectangular rod 20C and then the rod is then slid over the pins. Aligned apertures 80 extending through the rod 20C provide for the passage of the pin through the rod. With the rod so positioned, the anchor elements 78 are then engaged over the pins 78 and secured in place on the upwardly disposed anchor bolts 70. Nuts 82 are threadably engaged with the end portions 72 of the bolts 70 to secure the angle-shaped anchor elements 72 and 74 in place on the rearward face of the panel. In the assembled condition, the anchor elements hold the geo-grid wrapped around the rod 20C under compression. The pins 76 pass through the apertures of the geo-grid and serve to further secure the geo-grid to the rod.

In the eighth embodiment, connection does not depend upon clamping the geo-grid to the face panel P1. There is actually space between the geo-grid wrapped around the rod 20C and the rearward surface 26A of the panel (see FIG. 21). The strength of the connection results from the frictional resistance achieved by wrapping the geo-grid around the rectangular rod 20C and the clamping of the geo-grid between the rectangular rod and the angle-shaped anchor elements 74, 78. Although the connection is not dependent upon the transverse members of the geo-grid, these members do contribute to the strength of the connection and the resistance of pullout of the geo-grid from the anchor elements. This results from the frictional resistance provided by the transverse members and may also result from engagement of the members with the pins 76.

Conclusion

While preferred embodiments of the invention have been illustrated and described, it should be understood that the invention is not limited to the specifics of these embodiments, but rather is defined by the accompanying claims.

We claim:

1. In combination with a flexible plastic soil reinforcing geo-grid having spaced tension members extending into an earthen formation and transverse members extending across the tension members at spaced intervals to tie the tension members together and define apertures extending through the geo-grid between the tension members, an improved connection for securing the geo-grid to a retaining face for the earthen formation, said connection comprising:

a) an end portion of the geo-grid folded back upon itself a plurality of times adjacent the face so as to provide a grid section comprised of a sandwich of juxtaposed layers of geo-grid having continuous overlapping tension members and aligned apertures defining an opening extending therethrough between transverse members with multiple layers of transverse members on at least one side of the opening;

b) an anchor secured to and extending rearwardly from the face, said anchor having a protruding section extending through the opening from one side of the grid section; and, c) a retaining rod secured to the anchor to a side of the grid section opposite said one side to secure the geo-grid to the anchor rearwardly of the face.

2. In a combination according to claim 1, the improved connection wherein:

a) the end portion is folded upon itself to provide a layer of geo-grid to opposite sides of the tension members extending into the formation; and, b) the retaining rod clamps the tension members extending into the formation between the layers of geo-grid to opposite sides thereof.

3. In a combination according to claim 1, the improved connection wherein:

a) the protruding section of the anchor extends directly from a rearward surface of the face;

b) the end portion of the geo-grid is juxtaposed to the rearward surface of the face with the protruding section extending through the opening; and, c) the retaining rod clamps the tension members extending into the formation between the rearward surface of the face and multiple juxtaposed layers of the geo-grid.

4. In a combination according to claim 3, the improved connection wherein:

a) the protruding section comprises a closed loop extending from the rearward surface; and, b) the retaining rod extends through the loop and over the juxtaposed layers of the geo-grid.

5. In a combination according to claim 1, the improved connection wherein the face is a cast concrete panel and the anchor is cast in place within the panel.

6. In combination with a flexible plastic soil reinforcing geo-grid having spaced elongate tension members extending into an earthen formation and transverse members extending across the tension members at spaced intervals to tie the tension members together and define apertures extending through the geo-grid between the tension members, an improved connection for securing the geo-grid to a retaining face for the earthen formation, comprising:

a) an end portion of the geo-grid folded back upon itself adjacent the face to provide a sandwich of superimposed layers of grid with generally aligned apertures defining an opening extending therethrough between the transverse members;

b) an anchor secured to and extending rearwardly from the faces, said anchor having a protruding section extending through the opening in the superimposed layers of grid; and, c) a retaining rod extending through the protruding section of the anchor to one side of the superimposed layers to clamp the elongate tension members in compression.

7. In a combination according to claim 6, the improved connection wherein the opening has multiple layers of transverse members on at least one side of the opening.

8. In a combination according to claim 6, the improved connection wherein:

a) the anchor extends horizontally from the face;

b) the protruding section extends vertically through the superimposed layers; and, c) the retaining rod extends through the protruding section to secure the superimposed layers in generally parallel relationship to the anchor.

9. In a combination according to claim 6, the improved connection wherein:

a) the anchor extends horizontally from the face;

b) the end portion of the geo-grid is bent to extend vertically;

c) the protruding section extends horizontally through the superimposed layers; and, d) the retaining rod extends through the protruding section to clamp the superimposed layers to the face.

10. In a combination according to claim 6, the improved connection wherein:

a) the protruding section comprises a closed loop extending from the rearward surface; and, b) the retaining rod extends through the loop and over the superimposed layers of the geo-grid.

11. In combination with a flexible plastic soil reinforcing geo-grid having spaced elongate tension members extending into an earthen formation and transverse members extending across the tension members at spaced intervals to tie the tension members together and define apertures extending through the geo-grid between the tension members, an improved connection for securing the geo-grid to a retaining face for the earthen formation, comprising:

a) a horizontal retaining rod disposed rearwardly of the face;

b) an end portion of the geo-grid having tension members wrapped around the rod and extending therefrom over the tension members of the geo-grid extending into the formation;

c) an anchor secured to and extending rearwardly from the face and through an aperture in the geo-grid; and, d) means securing the anchor to the rod to clamp the end portion of the mat wrapped around the rod to the face.

12. In a combination according to claim 11, the improved connection wherein:

a) the anchor comprises a closed loop; and, b) the retaining rod extends through the loop to provide the means securing the anchor to the rod.

13. In a combination according to claim 11, the improved connection wherein:

a) the face is a welded wire gridwork having spaced elements;

b) the anchor is of a generally Z-shaped configuration having a bight portion spanning the spaced elements and end portions extending over and under said spaced elements, one of which end portions extends through the rod; and c) the means securing the anchor to the rod comprises a retaining element engaged with the rod and the end portion extending through the rod.

14. In a combination according to claim 13, the improved connection wherein the rod is of an angle-shape having intersecting leg portions and the end portion extends through one of the leg portions.

15. In a combination according to claim 13, the improved connection wherein the rod is cylindrical and the end portion extends transversely across the rod.

16. In combination with a generally horizontally disposed flexible plastic soil reinforcing geo-grid having spaced tension members extending into an earthen formation and transverse members extending across the tension members at spaced intervals to tie the tension members together and define apertures extending through the geo-grid between the tension members, an improved connection for securing the geo-grid to a retaining face for the earthen formation, said connection comprising:

a) an end portion of the geo-grid folded back upon itself a plurality of times adjacent the face so as to provide a grid section comprised of a sandwich of juxtaposed layers of geo-grid having continuous overlapping tension members and aligned apertures defining transversely spaced openings extending therethrough with multiple layers of transverse members on at least one side of the openings;

b) a generally horizontally disposed elongate anchor secured to and extending across the face, said anchor having protruding sections fixed thereto at spaced intervals and protruding, respectively, through transversely spaced openings in the grid section from one side of the grid section; and, c) a retaining rod extending through the protruding sections to a side of the grid section opposite said one side to secure the geo-grid to the anchor rearwardly of the face.

17. In a combination according to claim 16, the improved connection wherein:

a) the end portion is folded upon itself to provide a layer of geo-grid to opposite sides of the tension members extending into the formation; and, b) the retaining rod clamps the tension members extending into the formation between the layers of geo-grid to opposite sides thereof.

18. In a combination according to claim 16, the improved connection wherein:

a) the protruding sections of the anchor extend directly from a rearward surface of the face;

b) the end portion of the geo-grid is juxtaposed to the rearward surface of the face with the protruding sections extending through the openings; and, c) the retaining rod clamps the tension members extending into the formation between the rearward surface of the face and multiple juxtaposed layers of the geo-grid.

19. In a combination according to claim 18, the improved connection wherein:

a) the protruding sections comprise a closed loops extending from the rearward surface; and, b) the retaining rod extends through the loops and over the juxtaposed layers of the geo-grid.

20. In a combination according to claim 16, the improved connection wherein the face is a cast concrete panel and the anchor is cast in place within the panel.

21. In combination with a flexible plastic soil reinforcing geo-grid having spaced tension members extending into an earthen formation and transverse members extending across the tension members at spaced intervals to tie the tension members together and define apertures extending through the geo-grid between the tension members, an improved method for securing the geo-grid to a retaining face for the earthen formation, said method comprising:

a) folding an end portion of the geo-grid back upon itself a plurality of times adjacent the face so as to provide a grid section comprised of a sandwich of juxtaposed layers of geo-grid having continuous overlapping tension members and aligned apertures defining an opening extending therethrough between transverse members with multiple layers of transverse members on at least one side of the opening;

b) securing an anchor to the face so as to extend rearwardly therefrom with a protruding section of the anchor extending through the opening from one side of the grid section; and, c) securing a retaining rod to the anchor to a side of the grid section opposite said one side to secure the geo-grid to the anchor rearwardly of the face.

22. In a combination according to claim 21, the improved method wherein:

a) folding the end portion upon itself is carried out to provide a layer of geo-grid to opposite sides of the tension members extending into the formation; and, b) securing the retaining rod clamps the tension members extending into the formation between the layers of geo-grid to opposite sides thereof.

23. In a combination according to claim 21, the improved method wherein:

a) folding the end portion of the geo-grid juxtaposes the end portion to the rearward surface of the face;

b) securing the anchor extends the protruding section of the anchor directly from a rearward surface of the face with the protruding section extending through the opening; and, c) securing the retaining rod clamps the tension members extending into the formation between the rearward surface of the face and multiple juxtaposed layers of the geo-grid.

24. In a combination according to claim 23, the improved method wherein:

a) the step of securing the anchor is carried out so that the protruding section comprises a closed loop extending from the rearward surface; and, b) the step of securing the retaining rod extends the rod through the loop and over the juxtaposed layers of the geo-grid.

25. In combination with a flexible plastic soil reinforcing geo-grid having spaced elongate tension members extending into an earthen formation and transverse members extending across the tension members at spaced intervals to tie the tension members together and define apertures extending through the geo-grid between the tension members, an improved connection for securing the geo-grid to a retaining face for the earthen formation, comprising:

a) a retaining rod extending generally horizontally rearwardly of the face;

b) an end portion of the geo-grid wrapped around the rod;

c) an anchor secured to and extending rearwardly from the face, said anchor having a protruding portion extending through the retaining rod and the end portion of the geo-grid wrapped therearound; and, d) means engaged with the protruding portion to secure the retaining rod to the anchor.

26. In a combination according to claim 25, the improved connection wherein the means engaged with the protruding portion clamps the end portion of the geo-grid wrapped around the rod between the rod and the anchor.

27. In a combination according to claim 25, the improved connection wherein the protruding portion of the anchor is disposed to maintain the rod and the end portion of the geo-grid wrapped therearound rearwardly spaced from the face.

28. In a combination according to claim 25, the improved connection wherein the means engaged with the protruding portion comprises an element secured to the face in spaced apposition to the anchor whereby the retaining rod is captured between the anchor and the element.

29. In a combination according to claim 28, the improved connection wherein the protruding section extends through an aperture in the element secured to the face.

30. In combination with a flexible plastic soil reinforcing geo-grid having spaced tension members extending into an earthen formation and transverse members extending across the tension members at spaced intervals to tie the tension members together and define apertures extending through the geo-grid between the tension members, an improved connection for securing the geo-grid to a retaining face for the earthen formation comprised of open-celled concrete blocks having grooves extending transversely thereof, said connection comprising:

a) an end portion of the geo-grid folded back upon itself adjacent the face so as to provide a grid section with continuous overlapping tension members and an opening extending therethrough between transverse members;

b) an anchor including a transverse section engaged with the grooves to secure the anchor against separation from the blocks, said anchor extending rearwardly from the face and having a protruding section extending through the opening from one side of the grid section; and, c) a retaining rod secured to the anchor to a side of the grid section opposite said one side to secure the geo-grid to the anchor rearwardly of the face.

31. In combination with a flexible plastic soil reinforcing geo-grid having spaced tension members extending into an earthen formation and transverse members extending across the tension members at spaced intervals to tie the tension members together and define apertures extending through the geo-grid between the tension members, an improved connection for securing the geo-grid to a welded wire gridwork face for the earthen formation having spaced elements, said connection comprising:

a) an end portion of the geo-grid folded back upon itself adjacent the face so as to provide a grid section with continuous overlapping tension members and an opening extending therethrough between transverse members;

b) an anchor of a generally Z-shaped configuration having a bight portion spanning spaced elements of the welded wire gridwork face, end portions extending over and under said elements to secure the anchor to the gridwork face, and a protruding section extending through the opening from one side of the grid section; and, c) a retaining rod secured to the anchor to a side of the grid section opposite said one side to secure the geo-grid to the anchor rearwardly of the face.

* * * * *